US007763762B2

(12) United States Patent
Schlobohm et al.

(10) Patent No.: US 7,763,762 B2
(45) Date of Patent: Jul. 27, 2010

(54) METHOD FOR UNPRESSURIZED CATALYTIC CONVERSION OF ORGANIC SOLIDS INTO OIL

(75) Inventors: Wilfried Schlobohm, Pietzpuhl (DE); Alexander Julius, Hamburg (DE)

(73) Assignee: Wilfried Julius, Pietzpuhl (DE)

( * ) Notice: Subject to any disclaimer, the term of this patent is extended or adjusted under 35 U.S.C. 154(b) by 336 days.

(21) Appl. No.: 11/940,082

(22) Filed: Nov. 14, 2007

(65) Prior Publication Data

US 2009/0120840 A1 May 14, 2009

(51) Int. Cl.
*C01G 1/00* (2006.01)
*C01G 1/10* (2006.01)

(52) U.S. Cl. ..... 585/240; 585/242; 208/400

(58) Field of Classification Search ..... 585/240, 585/242; 208/113, 400, 409
See application file for complete search history.

(56) References Cited

U.S. PATENT DOCUMENTS

| | | | | |
|---|---|---|---|---|
| 5,780,696 | A * | 7/1998 | Bauer | 585/241 |
| 2002/0027173 | A1* | 3/2002 | Polifka | 241/5 |
| 2006/0004236 | A1* | 1/2006 | Barvincak | 585/240 |

FOREIGN PATENT DOCUMENTS

| | | | |
|---|---|---|---|
| DE | 44 35 379 | C1 | 11/1995 |
| DE | 100 49 377 | A1 | 4/2002 |
| DE | 101 11 765 | A1 | 9/2002 |
| EP | 0 705 795 | A1 | 4/1996 |

* cited by examiner

*Primary Examiner*—Walter D Griffin
*Assistant Examiner*—Renee Robinson
(74) *Attorney, Agent, or Firm*—Norris McLaughlin & Marcus, PA; Christa Hildebrand, Esq.

(57) ABSTRACT

A process is disclosed for unpressurized catalytic conversion of organic solids into oil, with the steps of conditioning the starting material, cracking in an oil reactor with simultaneous distilled separation of the desired hydrocarbon section, and discharging the solids obtained in the reaction, wherein conditioning of the floatable solid starting materials takes place in a micro vortex mill in an air carrier flow, and the resulting material particles are converted in the oil reactor, either directly or after temporary storage, with a dry content of ≧90% and a grain size of ≦100 μm, in particular ≦63 μm. Conditioning according to the invention can be used for all types of floatable organic solids and their mixtures. After processing in the micro vortex mill, the products supplied to the oil reactor produce high product yields with shorter reaction times, thereby substantially improving the economic benefits of the process.

6 Claims, No Drawings

METHOD FOR UNPRESSURIZED CATALYTIC CONVERSION OF ORGANIC SOLIDS INTO OIL

BACKGROUND OF THE INVENTION

Field of the Invention

The present invention relates to a method for the unpressurized catalytic conversion of organic solids into oil.

Conversion of organic solids, such as garbage, sewage sludge, animal and plant products, plastic refuse, renewable raw materials and their incidental or intended mixtures with one another, in decentralized facilities has become more and more important for fuel production, in particular the production of diesel fuel.

For example, DE 10049 377 A1 and DE 101 11 765 A1 describe a process for catalytic production of diesel oil and gasoline from hydrocarbon-containing trash and oils, whereby granular starting materials and/or biological and mineral oils are catalytically cracked in a reactor. After cracking, the desired hydrocarbon fractions are separated by distillation. All solids produced in the reaction are discharged from the reactor. A catalyst of sodium aluminum silicate is used in the cracking process.

Disadvantageously, in conventional processes, the cracking process, in particular the cracking rate and the reaction temperature, depend on the type of the organic starting materials used, but also on the employed catalyst, and the relative bandwidth in the spectrum of the distilled fractions, which can adversely affect the quality of the produced diesel oil fraction.

DE 44 35 379 C1 and EP 0 705 795 A1 describe a method for processing sludge, in particular sewage sludge contaminated with organic and/or heavy metal compounds. The sludge is mixed with quick lime and converted into a floatable substance as a result of the occurring exothermic reaction. Thereafter, the sludge is fed into a micro vortex mill in an air flow and remains suspended in air in the micro vortex mill until about 99 mass-% of the sludge are comminuted to a particle size of less than 0.15 mm. The solid material is separated from the exhaust air when the comminuted material is discharged from the micro vortex mill. With this process, a significant portion of the organic compounds and the heavy metal compounds can be separated from the comminuted material and/or converted into an inert form.

SUMMARY OF THE INVENTION

The foregoing disadvantages of the prior art are overcome by providing a process which obviates the disadvantages of conventional processes for unpressurized catalytic conversion of organic solids into oil, enhances the economic benefits of the process and improves the quality of the obtained diesel oil fraction. More particularly, it is also an object of the invention to provide a process for the unpressurized catalytic conversion of organic solid materials, which operates efficiently at a high material flow rate at relatively low reaction temperatures using different starting materials, and which produces diesel oil of high quality.

The object is attained by the a process for unpressurized catalytic conversion of organic solids into oil, with the steps of conditioning the starting material, cracking in an oil reactor with simultaneous distilled separation of the desired hydrocarbon section, and discharging the solids obtained in the reaction, wherein the floatable solid starting materials are conditioned in a micro vortex mill in an air carrier flow, and the resulting material particles are converted in the oil reactor, either directly or after storage, with a dry content of ≧90% and a grain size of ≦100 μm, in particular ≦63 μm. The air flow supplying the floatable material to the micro vortex mill may be preheated. The floatable materials may include sewage sludge, wood, fibrous materials, plastic refuse, garbage, animal and plant products, including mixtures thereof.

It has been observed that by processing organic solid materials in a micro vortex mill, on one hand, the solid materials are dried and comminuted into fine particles and, on the other hand, the organic components also activated, which significantly accelerates the catalytic oil conversion process and also distributes the reaction products more uniformly, and which furthermore significantly improves the quality of the produced diesel fraction. The particles activated during the treatment in the micro vortex mill remain activated under storage, meaning that the activation does not dissipate already within a short time.

It was completely unexpected and could not have been predicted that treatment of organic solids in a micro vortex mill not only comminutes and dries the solids as intended, but also solubilizes and activates the organic components of the solid materials, leading to the aforedescribed effects during a subsequent unpressurized catalytic conversion into oil.

Compared to conventional processes, the process of the invention of unpressurized catalytic conversion into oil produced independent of the starting materials, i.e., with sewage sludge, fermentation residues, scrap wood, biomass based on renewable raw materials, plastic refuse, garbage, etc., significantly accelerates the reaction process of up to a factor of 10, reduces the reaction temperature by 10 to 15%, and has a high yield for high quality diesel oil with a impurity low content.

The process of the invention and its advantageous effects will now be described with reference to the following exemplary embodiments:

Unpressurized catalytic conversion of communal sewage sludge into oil.

DETAILED DESCRIPTION

Example 1

Communal sewage sludge with a residual moisture content of 85% is supplied in a preheated air flow to a micro vortex mill and is suspended in the air flow inside the micro vortex mill. For each kilogram of dry mass of supplied solid material, 30 m3 air are used. The temperature of the preheated air is 140° C.

Due to the extremely strong turbulence inside the micro vortex mill a large number of collisions occur between the solid particles and between the solid particles and the walls of the micro vortex mill. The impact energy is hereby so high that significant cavitation is produced. The generated thermomechanical stress on the solid particles causes strong comminution, which in turn separates and activates the organic components. The solid particles inside the micro vortex mill are typically heated to temperatures between 250 and 270° C. and are dried to a residual moisture content of about 7% (≧90% dry content).

The organic particles are discharged from the micro vortex mill in the air flow after comminution to a final particle diameter of less than 63 μm. This takes place after a typical residence time of three seconds for the particles in the micro vortex mill. The conditioned solid particles are separated from the air flow in a cyclone separator having a downstream bag filter. The conditioned activated solid particles can also be supplied, either directly or after intermediate storage, to a reaction space for subsequent unpressurized catalytic conversion into oil. Compared to an unpressurized catalytic conversion of solid materials into oil that have not been processed in a micro vortex mill, the conversion process into oil is 2 times to 10 times faster and occurs at a 10 to 15% lower temperature, i.e., at temperatures between 350 and 360° C. The produced diesel oil is comparatively pure, with only a low fraction of high-boiling-point hydrocarbons. The produced diesel oil can be used, after separation of the gasoline fractions and optionally precipitation of water, directly as fuel for conventional diesel engines; however, the addition of commonly used additives is advisable.

The process of the invention of unpressurized catalytic conversion of organic solids into oil is significantly more efficient compared to conventional processes, is significantly faster and requires less energy and produces a diesel fuel of noticeably higher quality. According to the present understanding of the process, this is attained by 1. the lower residual moisture content of a less than 20%,
2. the huge increase in the surface of the solid material as a result of the comminution of the solid particles to a particle size of about ≦100 μm, and
3. the activation of the solid particles due to the comminution of at least a portion of the hydrocarbon compounds.

However, there is so far no full explanation of the processes and events that occur the organic solids are processed in a micro vortex mill. Nevertheless, all comparative experiments have shown that when organic solids are processed in a micro vortex mill under the described process conditions, the subsequent unpressurized catalytic conversion into oil is significantly faster and occurs at a reaction temperature that is 10 to 15% lower than in conventional processes, producing as reaction product (diesel oil) of noticeably higher quality.

Example 2

The conditions are identical to those in Example 1, except that the residual moisture content of the sewage sludge to be conditioned is 72%. Sewage sludge is conditioned under the same process conditions and is discharged from the micro vortex mill in an air flow with a particle size of ≦63 μm. The residual moisture content of the conditioned activated solid particles is ≦20%.

Unpressurized catalytic conversion of wood chips into oil

Example 3

Shredded wood chips having a size of ≦10 mm and a residual moisture content of 40% are fed to a micro vortex mill in a preheated air flow, like in the Examples 1 and 2, and are suspended in the air flow inside the micro vortex mill. The wood chips are conditioned under the same process conditions as in Example 1 and are discharged from the micro vortex mill in the air flow after attaining a particle size of ≦63 μm. The conditioned particles have a residual moisture content of about 12%.

The subsequent unpressurized catalytic conversion of the wood chips into oil that were processed in the micro vortex mill occurs under the same conditions as described with reference to Example 1 and produces the same advantageous effects with respect to the process and the quality of the reaction products (diesel oil).

The invention claimed is:

1. A method for unpressurized catalytic conversion of organic solids into oil, comprising the steps of:

conditioning a starting material comprising floatable solids, cracking in an oil reactor with simultaneous distilled separation of desired hydrocarbon section, discharging solids obtained in the reaction, wherein the floatable solid starting materials are conditioned in a micro vortex mill in an air carrier flow, and converting the resulting material particles in an oil reactor, either directly or after storage, with a dry content of ≧90% and a grain size of ≦100 μm, and wherein collisions occur between the floatable solid starting materials generating thermo-mechanical stress that causes comminution which in turn separates and activates organic components in the floatable solid starting materials.

2. The method according to claim 1, comprising an additional step of preheating the floatable material to the micro vortex mill.

3. The method according to claim 2, wherein the floatable materials comprise sewage sludge, wood, fibrous materials, plastic refuse, garbage, animal and plant products, including mixtures thereof.

4. The method according to claim 1, wherein the resulting material particles converted in the oil reactor, either directly or after storage are having a dry content of ≧90% and a grain size of ≦63 μm.

5. The method according to claim 1, wherein the resulting material particles converted in the oil reactor, either directly or after storage are having a residual moisture content of about 7%.

6. The method according to claim 1, wherein the resulting material particles converted in the oil reactor, either directly or after storage are having a residual moisture content of about 12%.

* * * * *

UNITED STATES PATENT AND TRADEMARK OFFICE

CERTIFICATE OF CORRECTION

PATENT NO. : 7,763,762 B2
APPLICATION NO. : 11/940082
DATED : July 27, 2010
INVENTOR(S) : Schlobohm et al.

It is certified that error appears in the above-identified patent and that said Letters Patent is hereby corrected as shown below:

Title page item 57, line 10, - Col. 2 lines 2, 3, 59 - Col. 3, lines 22, 41, 43, 48 - Col. 4 lines 4, 25, 39, and 40.

All instances of "≦" should read -- ≤ --.

All instances of "≧" should read -- ≥ --.

Signed and Sealed this
Ninth Day of August, 2011

David J. Kappos

David J. Kappos
*Director of the United States Patent and Trademark Office*